US006746389B2

(12) United States Patent
Selle et al.

(10) Patent No.: US 6,746,389 B2
(45) Date of Patent: Jun. 8, 2004

(54) METHOD AND APPARATUS FOR FOLDING OR SEPARATING BAGS

(75) Inventors: Paul Selle, Appleton, WI (US); Thomas Jansen, Appleton, WI (US); Timothy Dutter, Menasha, WI (US)

(73) Assignee: CMD Corporation, Appleton, WI (US)

( * ) Notice: Subject to any disclaimer, the term of this patent is extended or adjusted under 35 U.S.C. 154(b) by 0 days.

(21) Appl. No.: 09/948,169

(22) Filed: Sep. 6, 2001

(65) Prior Publication Data

US 2002/0049125 A1 Apr. 25, 2002

Related U.S. Application Data

(63) Continuation of application No. 09/415,879, filed on Oct. 8, 1999, now abandoned, which is a continuation of application No. 08/962,311, filed on Oct. 31, 1997, now abandoned.

(51) Int. Cl.[7] ..... B31B 1/26
(52) U.S. Cl. ..... 493/405; 493/416
(58) Field of Search ..... 493/405, 418, 493/450, 434, 435, 416

(56) References Cited

U.S. PATENT DOCUMENTS

| | | | | |
|---|---|---|---|---|
| 3,229,973 A | * | 1/1966 | Cornwall | 493/418 |
| 3,773,315 A | | 11/1973 | Tsien | |
| 3,797,820 A | * | 3/1974 | McDermott | 493/14 |
| 3,918,698 A | * | 11/1975 | Coast | 493/442 |
| 3,927,875 A | * | 12/1975 | Winnemoller et al. | 493/413 |
| 4,073,223 A | | 2/1978 | Crawford | |
| 4,234,179 A | | 11/1980 | Weir | |
| 4,487,598 A | | 12/1984 | McDonald | |
| 5,108,017 A | | 4/1992 | Adamski et al. | |
| 5,388,746 A | | 2/1995 | Hatchell et al. | |
| 5,624,366 A | | 4/1997 | Beeri | |
| 5,779,180 A | | 7/1998 | Smedt et al. | |
| 5,842,964 A | * | 12/1998 | Huber et al. | 493/434 |

FOREIGN PATENT DOCUMENTS

EP 0837020 A2 4/1998

* cited by examiner

*Primary Examiner*—Eugene Kim
(74) *Attorney, Agent, or Firm*—George R. Corrigan

(57) ABSTRACT

A folder and method for folding plastic bags includes at least one folding station. The folding station has a folding point where an input, an output and a storage portion meet. The bag travels in the input portion in a different direction than in the storage portion. The output direction is substantially the same as the input direction. A turning air source is disposed to direct the bag into the storage portion and an air source is disposed to direct the bag into the output section. A fin helps guide the bag into the output portion. A turning roll disposed above the turning point, and imparts motion to the bag, generally in the storage direction. A second folding station, similar to the first, is downstream the first folding station. The output direction for the first station is the same as the input direction for the second station, and the bag path between the first and second folding stations is substantially linear. A separator located upstream of the folder includes a separator nip formed by separator rolls that are in, and remain in, the film path in one embodiment. A slow-down section includes servo-driven slow down rolls with projections there on.

9 Claims, 3 Drawing Sheets

METHOD AND APPARATUS FOR FOLDING OR SEPARATING BAGS

This is a continuation of, and claims the benefit of the filing date of, U.S. patent application Ser. No. 09/415,879, filed Oct. 8, 1999, now abandoned, entitled Method And Apparatus For Folding Or Separate Bags, which is a continuation of, and claims the benefit of the filing date of, U.S. patent application Ser. No. 08/962,311, filed Oct. 31, 1997, now abandoned, entitled Method And Apparatus For Folding Or Separating Bags.

FIELD OF THE INVENTION

The present invention relates generally to the art of making bags from a plastic film. More specifically, it relates to a method and apparatus for folding and separating bags.

BACKGROUND OF THE INVENTION

There are many uses and designs for plastic bags. Such bags are typically manufactured from plastic films, and there are many known machines for automatically making bags from such a film. Some bag making machines create bags on a continuous strip of plastic film or web (typically a flattened tube or a continuous folded sheet. Bags are made by forming seals (typically transverse to the machine direction or along the side of the film). Adjacent bags are separated from one another by forming a perforation parallel to (and preferably close to) the seal. The perforation allows the bags to be separated (either manually or in a downstream device).

Bag making machines often include equipment that separates adjacent bags and then folds and stacks the separated bags. Bags are separated in some prior art machines by operating a downstream nip at a higher speed than the speed at which the upstream film or web is travelling. When the perforated film or web encounters the downstream rollers (often called separation rollers), the higher speed of the rollers pulls the web, thereby tearing along the perforations. The separation rollers are typically mounted on a cam, cylinder, or some other device, which intermittently brings the separation rollers into contact with each other and the film, to separate adjacent bags. This sort of separation was adequate at lower speeds, but it often limited the operating speed.

An example of the intermittent contact type of prior art separator is found in U.S. Pat. No. 5,388,746 issued Feb. 14, 1995. This is a complex design and the oversped rolls are operated at a constant speed, thus the available control is limited.

Many prior art separators include an infeed nip formed by driven rolls. This results in a linear speed difference between the ropes and the rolls. Prior art separators also often include a zone where the bag is not between ropes, as the separated bag passes from the separator to the downstream section (such as a folder). The bags are not controlled at that gap, and can jam the machine. Additionally, prior art machines typically have ropes which are returned by rolls in the film path. Thus, a pinch point that can catch the film or bag is created between the rope and the roll. This can create jams in the machine.

After the bags have been separated it is common for them to be provided to a folder that folds the bags one or more times. Generally, a folder includes a number of folding sections, wherein the maximum number of folds available is equal to the number of folding stations.

U.S. Pat. No. 5,388,746, issued Feb. 14, 1995, shows a prior art folder. The folder shown therein includes three folding sections located downstream of a separator. The separated bags are traveling in a downward direction as they approach each folding station. The leading edge of the bag passes a folding nip, and then the middle of the bag is blown in a direction almost perpendicular to the original path direction (close to horizontal). The bag is grabbed in a nip and then folded. The bag continues on in a substantially horizontal direction until it approaches the second folding station. Then, the bag must be redirected in a downward direction where the second folding station operates substantially as did the first folding station. A third folding station (also mounted such that the bag must enter it in a downward direction) is also provided.

The arrangement shown in U.S. Pat. No. 5,388,746 is relatively complex, and the bags make two turns for each fold. The bags are travelling in one direction entering the folding point, and exit the folding station in a different direction. Thus, the momentum of the trailing end of the bag is not useful in helping to crease the new fold bag because of the different directions. The extra turns in the path of the bags also make handling the bags more difficult and more likely for jams or other failures of the process.

Moreover, the path of the return ropes is such that access to the folding stations for service, adjustment etc. is relatively difficult. Also, because the bags are not held by ropes or nips immediately prior to the folding point, there is an opportunity for a bag to be skewed or improperly folded.

After the bags have been folded they typically are slowed down so that they may be more easily managed in downstream processing stations. One prior art method for slowing down folded bags is a passive system, wherein the bags enter a slow down section, and are allowed to gradually slow down to rope speed. One problem with this passive slowing down is that the bags can easily become skewed from the machine direction, and it is hard to properly control the bag speed.

Another prior art slow down section includes a downward discharge. The bag falls in the downward discharge into two belts that form a V. The apex of the V is a nip such that the bag falls into that nip and is slowed down by the speed of the belts. One problem with this arrangement is that the bag can bunch up as it enters the nip.

Another prior art method is shown in U.S. Pat. No. 4,073,223, issued Feb. 14, 1978. This method uses a rudimentary form of control wherein a pair of rollers are operating at a slower speed than the upstream machine speed. The rollers have bars mounted thereon, arranged such that when the rollers rotate, the bars come in contact with one another. The rollers are turned such that momentary contact is made between the bars and the trailing edge of the bag, thereby slowing the bag down. One problem with this system is that the rotation of the rollers is a continuous motion system which is not indexed to each bag. Thus, it is difficult to maintain the proper timing over a long period of operation of the machine. Also, there are other timing related problems which occur at certain speeds and bag lengths.

Accordingly, it is desirable for a separator and folder to include a separator that properly separates adjacent bags. Additionally, the separator should be designed such that bags are not likely to flutter as they leave the separator. Preferably, such a folder and separator should also provide for continuous holding of separated bags to prevent fly back.

The folding section should preferably be configured without unnecessary turns so as to avoid unnecessary complexity and cost. Preferably, it should be designed such that in the event less than the maximum number of folds is being implemented the bag does not have to undergo turns. Improperly folded bags should be discharged in downward direction so they do not cause jams. The folding section should be easily accessible from the top. Also, the folding section should utilize the momentum of the bag prior to the folding to help fold the bag.

A slow down section preferably includes a slow down nip that is easy to control and can be precisely aligned with the bags.

SUMMARY OF THE PRESENT INVENTION

According to a first aspect of the invention a folder, and method for folding, plastic bags includes at least one folding station. The folding station has a folding point at which an input portion, an output portion, and a storage portion meet. The bag travels in an input direction in the input portion, in an output direction in the output portion, and in a storage direction in the storage portion. The input direction is different from the storage direction.

In one embodiment the output direction is substantially the same as the input direction. In another the input direction is substantially horizontal. The storage direction has a downward component in an alternative embodiment. The storage direction is preferably less than 30° from vertical.

A turning air source is disposed to direct the bag into the storage portion in another embodiment. A folding air source is disposed to direct the bag into the output section in another embodiment. A fin is disposed to help guide the bag into the output portion in an alternative. A turning roll is disposed above the turning point, and imparts motion to the bag, generally in the storage direction, in yet another embodiment.

The folder includes a second folding station downstream of the first folding station in another embodiment. The second folding station is configured like the first folding station.

The output direction for the first station is the same as the input direction for the second station, and the bag path between the first and second folding stations is substantially linear in another embodiment.

The folder includes a separator located upstream of the folder in another alternative. The separator includes a separator nip formed by separator rolls that are in, and remain in, the film path in one embodiment. The separator rolls are preferably servo-driven rolls.

The separator includes guides, such as ropes or belts, that guide the bag through at least a part of the separator. The folder includes guides, such as ropes or belts, that guide the bags through at least one part of the folder. The separator guides overlap the folder guides. The guides have return rolls located out of the film path in another embodiment.

The folder includes a slow-down section located downstream of the folding station in an alternative. The slow-down-section preferably includes two servo-driven rolls, each with at least one projection thereon, disposed to contact the bags. In one embodiment each servo-driven roll has two projections.

Other principal features and advantages of the invention will become apparent to those skilled in the art upon review of the following drawings, the detailed description and the appended claims.

Figure 1:
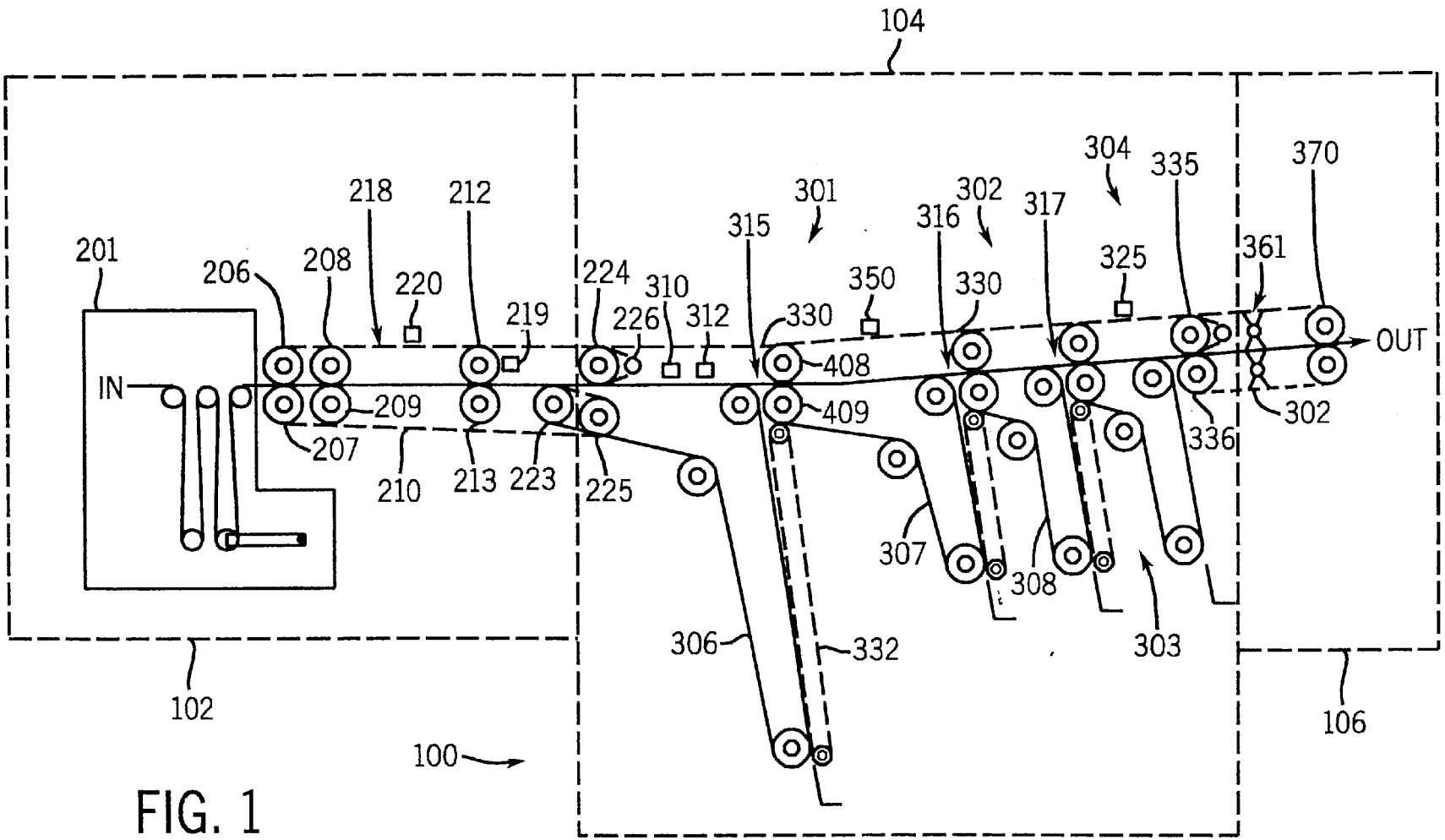
FIG. 1 is a diagram of a folder, separator, and slow down section constructed in accordance with the present invention.

Before explaining at least one embodiment of the invention in detail it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting. Like reference numerals are used to indicate like components.

DETAILED DESCRIPTION OF THE PREFERRED EMBODIMENTS

While the present invention will be illustrated with reference to a particular separator, folder and slow down section used for plastic bags, it should be understood at the outset that the invention can also be employed using other components and designs, one or more of the separator, folder and slowdown section described herein, or for pliable items other than bags.

Generally, the preferred embodiment includes a separator that receives a continuous film of bags. The bags are formed by placing seals on the film, and adjacent bags are also separated by perforations. Bags are separated in the separator, and then provided to a folder which includes a plurality of folding stations. The bags are folded by each folding station (up to three times in the preferred embodiment) after leaving the folding station. The bags are then provided to a slow down unit.

Referring now to FIG. 1 a bag machine 100 is shown and constructed in accordance with the preferred embodiment. Machine 100 includes a separator 102, a folder 104, and a slowdown station 106. Generally, a film of bags is provided to separator 102 from an upstream bag machine that forms the bag, or from a roll of previously formed bags. Top and bottom ropes or belts are provided throughout machine 100 in the preferred embodiment. Generally, at speeds greater than 400 feet per minute, top and bottom ropes are needed to prevent the film from folding back (fly-back) or from having fatal fluttering.

The speed of separator 102 is controlled to follow the speed at which the film is being fed to separator 102. Separator 102 includes a nip with over speed rolls that speed up the leading edge of a bag, thereby separating the bag from the film. After the bags are separated they are provided to folder 104. Folder 104 includes three folding stations (described in detail below), an inspection station and ironing rolls. Each folding station can impart one fold in the machine direction of the bag. Thus, the final bag may be folded up to three times (and will be ⅛ the length of the incoming bag). However, it is possible to not use one or more of the folding stations in the preferred embodiment. The path the bag takes through the folding stations is in a single plane, except where the leading edge is temporarily diverted downward.

The bags are provided to slow down section 106 after folding. Slow down section 106 includes, in the preferred embodiment, slow down rolls and a corrugator. Slow down section 106 will be described in detail below. Machine 100 is generally driven by a single belt, except for the servodrives described below, and (in one embodiment) the slow down guide ropes.

Figure 2:
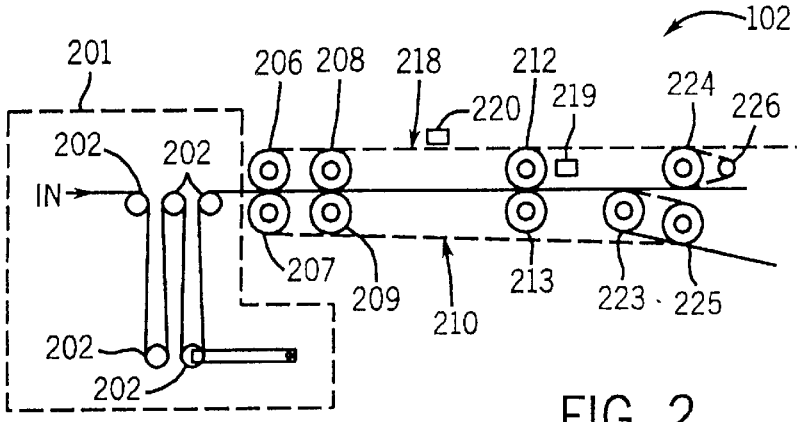
FIG. 2 is a diagram of the separator of FIG. 1.
Figure 3:
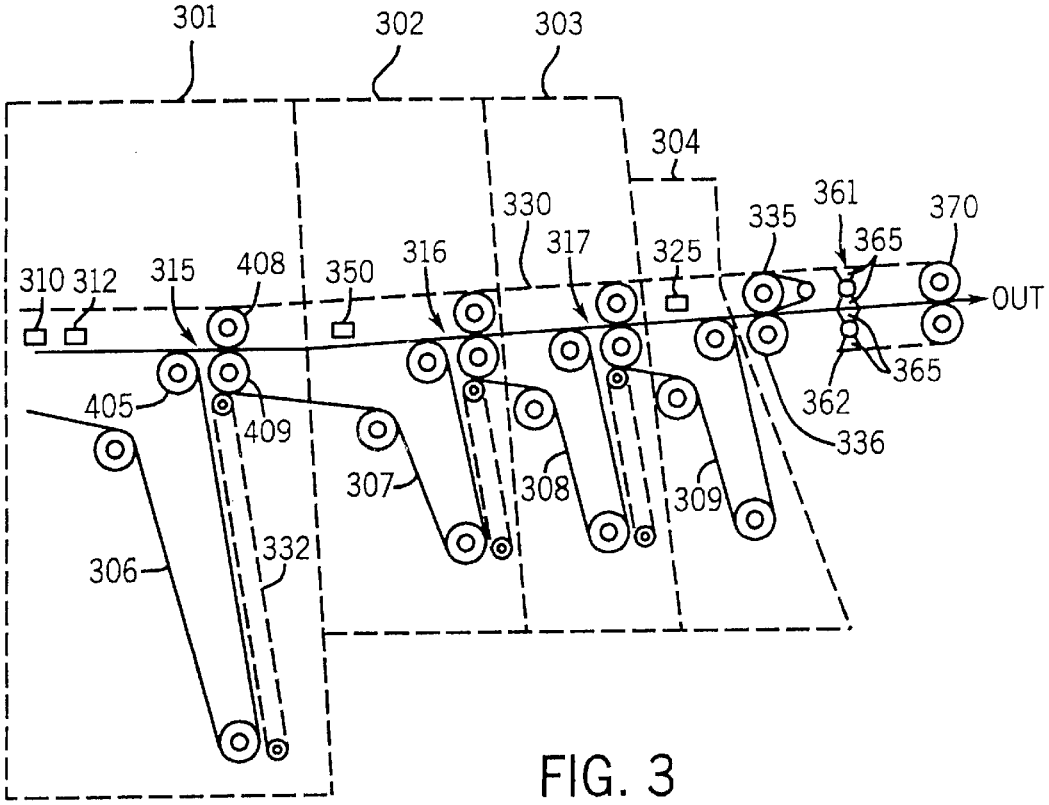
FIG. 3 is a diagram of the folder and slow down section of FIG. 1.

Separator 102, shown in detail on FIG. 2, includes an infeed section 201 which is comprised of a plurality of dancer rolls 202. Dancer rolls 202 are used to match the speed of machine 100 to the speed of the upstream bag machine in a conventional manner.

A pair of rope idlers rolls 206 and 207 receive the film of bags from dancer rolls 202. Rolls 206 and 207 do not form a nip. Thus, the speed of the ropes can be maintained at the speed of the main nip and the film. Specifically, the ropes can ride in grooves in the main nip roll, and thus the ropes and main nip rolls can have the same linear speed. A pair of rolls 208 and 209 form the main nip, and drive the film into the separator section (at machine speed).

After the film passes through the main nip it is carried by a plurality of ropes and/or belts 210 and 218 to a servo-driven separation nip formed by a pair of servo-driven rolls 212 and 213. The servo driven separation nip is controlled such that rolls 212 and 213 are intermittently oversped to separate adjacent bags. The control is performed by a controller such as a microprocessor, digital signal processor, or PLC. The PLC or controller uses an input device to sense the location of the leading edge of the film of bags in the preferred embodiment.

Ropes 210 and 218 extend from the rollers 206 and 207 through separator 102 and into folder 104 (described below). Ropes are used above the film to help prevent flutter and fly back of the film, and to help control the film as it is separated.

An electric eye 220 is located between the main nip and the servo-driven separation nip formed by rolls 212 and 213. Electric eye 220 senses gaps betweens the bags and is used to control the timing. Initially, the film of continuous bags is fed through machine 100. When the operator activates the folding function, the servo-driven separation nip is oversped by about 10%, thereby separating the leading bag from the following bag, and creating a gap between bags.

When the gap between bags is sensed by electric eye 220, the servo-driven separation nip is slowed down to slightly under machine speed, to pull out wrinkles in the separated bags. After a brief slow period the separation nip is brought back up to line speed. Also, a counter in the PLC or controller begins counting (when the gap is sensed), which effectively measures distance. After a sufficient length of bag has passed (as determined by the counter) the next perforation has moved into position for separation (just past the main nip). Electric eye 220 is enabled to detect gap and the servo driven separation nip again is oversped to separate the leading bag from the following bags (again creating a gap for electric eye 220 to sense). Then the separation nip returns to underspeed, taking out wrinkles, and the process is again repeated.

A static eliminator 219 is provided just after the servo-driven separation nip. Static eliminator 219 (along with a static pinner 310 describe below) create a constant level of static.

A plurality of rolls 223, 224, 225, and 226 are provided to create the transition between separator 102 and downstream folder 104. Rolls 224 and 223 guide and return the ropes serving the first folding station in folder 104. Rolls 226 and 225 return ropes 210 and 218 (i.e. they are return rolls) to section 102. It may be seen that there is an overlap between the ropes in the folder and separator sections in the preferred embodiment. This avoids the gap between sections common in prior art machines. The overlap helps to guide and drive the bags as they move from the separator to the folder.

Generally, rolls 225 and 226 are located away from the film path. Thus, they relocate the pinch point from being in the film path (either above or below the film path depending on whether the ropes are above or below the film) to out of the film path.

After the bags have been separated by rolls 212 and 213, the bags pass rolls 223–226 and enter folder 104. Generally, folder 104 includes a plurality of folding stations 301, 302, and 303, and an inspection section 304. Folders 301–303 are generally configured like one another, and function in a similar manner. A plurality of ropes 330 are provided above the path of the bags and extend throughout all of folder 104, including folding station 301–303. Preferably, folder 104 is run about 3% over speed to pull out wrinkles and maintain a gap between bags.

The bags in the folder 104 are carried by a plurality of sets of ¾ inch wide flexible belts 306, 307 and 308. One set of belts is provided for each folding station. Each belt is a flat belt with a V-guide on the back. The belt top has a flat surface ¾ inches wide on which the film rides. The V-guide tracks the belt around the various rolls.

Static pinner 310 is located between the beginning of the folding section and the first folding point. Static pinner 310 creates a known (and controllable) level of static. This is preferable to static levels that vary. A photo eye 312 detects the leading edge of each bag, and is used to control the process of turning on and off air that is used to control the bag in the folder.

Generally the operation of folding stations 301, 302, and 303 is such that the bags enter the folding station traveling in a horizontal path. Each folding station has a folding point 315–317. A source of air is located above the ropes at each folding point (315 e.g.) and directs the leading edge of the bag in the downward direction, following the guide belts 306–308. The substantially downward direction is a few degrees off of vertical in the preferred embodiment, although it may vary in alternative embodiments.

After the leading edge of the bag has traveled downward a distance sufficient so that the midpoint of the bag has reached the folding area an air nozzle located below the guide belts blows the middle of the bag into a nip. The section where the leading edge of the bag temporarily travels downward is referred to herein as the leading edge storage portion because the leading edge of the bag is temporarily "stored" therein, while the fold is being created.

The nip grabs the middle of the bag and pulls the bag away from the folding area. The bag is pulled in a horizontal direction. What had been the leading edge of the bag is pulled upward while the former trailing edge of the bag is pulled horizontally. The forward momentum of the tail of the bag is in the horizontal direction, and it helps push film into the fold nip which makes folding easier and more consistent. After the fold the bag is now configured such that what had been the leading edge of the bag joins the what had been the trailing edge of the bag to form the trailing edge (because the bag has been folded it has multiple trailing edges). What had been the middle of the bag becomes the leading edge, with a fold therein.

The path the bag travels as it approaches the folding point lies in a plane. That plane defines the input direction. Similarly, the plane in which the leading edge travels while being stored defines the storage direction. The output direction is defined by the plane in which the bag travels as it leaves the folding point. The output and input directions are substantially the same, but different from the storage direction, in the preferred embodiment.

Figure 4:
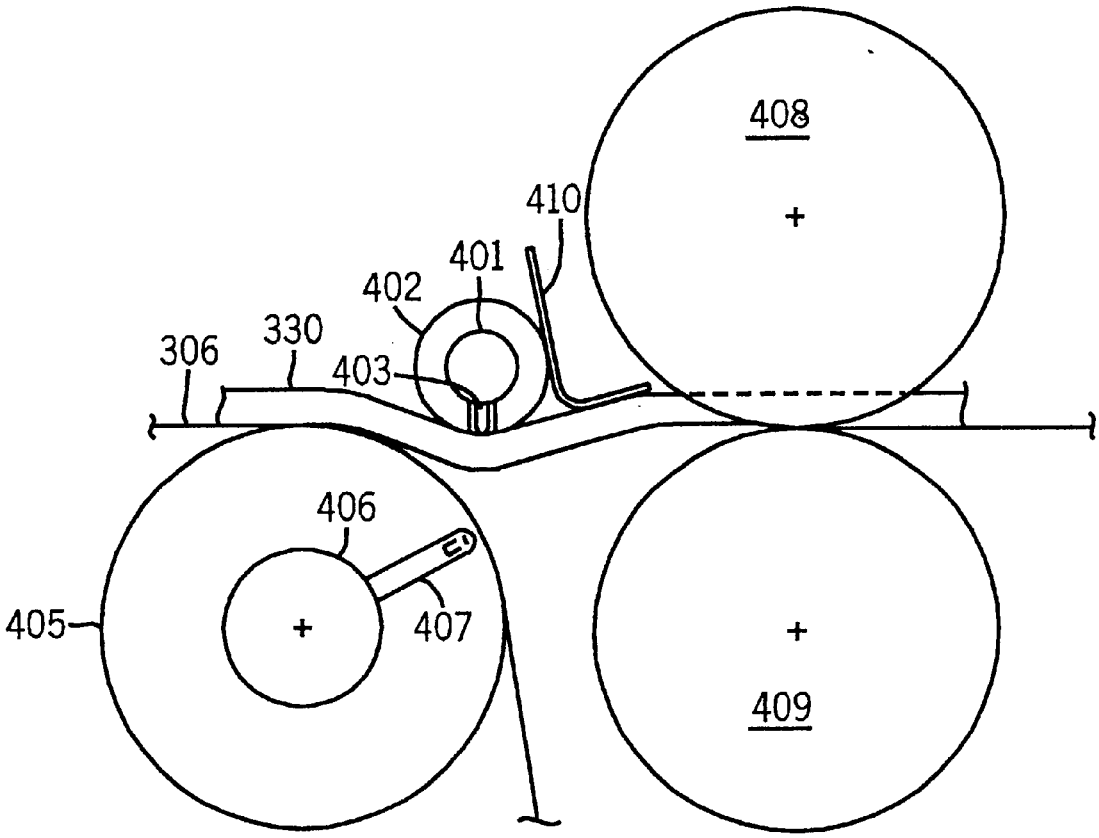
FIG. 4 is a detailed diagram of a folding point on a folding station of FIG. 3.

Referring now to FIG. 4, the folding point for folding station 301 is shown in detail (the folding point for stations 302 and 303 are arranged in an identical manner in the preferred embodiment). A turn air pipe 401 is located at folding point 315. Turn air pipe 401 is preferably a stationary pipe with a plurality of idler pulleys 402 on it. A plurality of nozzles 403 are screwed into pipe 401 between rollers 402. Thus, while the idler pulleys rotate with ropes 330, nozzles 403 remain in a fixed position. Nozzles 403 are positioned to blow the leading edge of the bag downward past a turning roll 405 (comprised of a plurality of idler pulleys). A set of ropes 332 (FIG. 1) are provided substantially parallel to belt 306 in the downward travelling portion (the storage portion) section to help reduce adverse flutter. The position of belts 306 and airpipe 401 is such that, in the preferred embodiment, the leading edge of the bag receives a slight downward push from the ropes to aid the air in directing the leading edge of the bag in the storage direction. The downward deflection is omitted in alternative embodiments. When the leading edge of the bag has traveled downward such that the midpoint of the bag has reached turning roll 405 nozzles 403 are turned off. The distance is determined using electric eye 312 and a counter in the PLC or controller.

A plurality of folding nozzles 407 are screwed into a fold air pipe 406. Nozzles 407 are turned on when nozzles 403 are turned off. Nozzles 407 are disposed within gaps between the idler pulleys 405, which are mounted on air pipe 406. Nozzles 407 blow air from the radial direction of pipe 406 in the preferred embodiment. Air blown in this direction draws air from both sides of the pipe and helps move the folded bag in the desired direction. The bag is then grabbed by rolls 408 and 409, and pulled downstream (in a substantially horizontal direction).

A fin 410 prevents the edges of the bag from being blown up between ropes 330 and into the upper roll. Fin 410 is an L shaped piece of metal mounted near air pipe 401.

Alternative embodiments include adjusting the angle of the nozzles with respect to the axis of pipe 406, and/or using varying diameter nozzles along the transverse direction (or cross machine direction) of pipe 406. Proper selection of the angle and diameter can help control the edge of the bag to avoid folding the corner of the bag under (called a dove tail). Dove tails can be caused when the edge of the bag is too far from a nozzle, for example, and the edge folds under. Angled nozzles and/or different diameter nozzles can help control the edges of the bag.

Subsequent folding sections are cascaded together so that successive folds can be made. Each section operates as did section 301. A fold may be skipped by leaving turn nozzles 403 off and folding nozzles 407 on, thus creating an airbridge in the gap. If a section is to be skipped, it should not be the first section because the first fold section is longer (and can handle an unfolded bag).

The downward travel paths (storage portion) are at a slight angle of approximately 8 degrees to vertical, in the preferred embodiment. This helps to avoid air turbulence on the leading edge of the bag traveling downward. Alternatives provide for angles of between 0–15 degrees, or as high as 30 degrees from vertical. Other alternatives include even greater (or negative angles). Generally, increasing the angle requires an increase in the size of the gap between the sections. A static pinner 350 is provided after section 301. Static pinner 350 helps hold the bag in position against the belt, as well as helps hold the folded bag together, and it helps the folded bag lay flatter.

An inspection section 304 is provided and looks much like a folding station. However, inspection section 304 either creates an air bridge, or it blows a bag downward to reject the bag: it does not fold bags. An electric eye 325 is used to sense the length of the bag. If the bag is too long (meaning the fold was either missed or not close enough to folding the bag in half to be acceptable) the bag is rejected.

Following the rejection section there is a pair of ironing rolls 335 and 336. Ironing rolls 335 and 336 form a smooth nip and take out wrinkles. They also help the folded bag lay flatter.

A slow down servo-nip is formed by two servo-driven rolls 361 and 362 and is located after ironing rolls 335 and 336. These rolls, which operate at a speed slower than the machine speed, have a pair of protrusions, projections, or pucks 365, which meet in the path of the bag when properly aligned. Pucks 365 are located generally side to side toward the centerline of the film web, so that the bag is "grabbed" near the centerline and skewing or cocking is avoided. Rolls 361 and 362 includes two sets of two pucks 180 degrees apart, so that each revolution provides for slowing down two bags. Each puck is about an inch long in the machine direction (so that it goes with the travel of the bag for about an inch), and an inch wide (so it does not grab the entire bag). The preferred slow down speed is to about 300 feet per minute, from a machine speed up to 1000 feet per minute (typically about 700 feet per minute).

The servo-drive has a simple motion profile wherein the initial position is just prior to grabbing the bag. When the bag is sensed the servo-nip grabs the tail end of bag for the inch of travel the pucks 365 contact the bag, and slows the bag down to the nip speed. Then rolls 361 and 362 increment back to the initial position. Alternatives include using a different number of pucks, circumferentially or transversely, depending on your particular wants and desires for the machine. Also, the motion profile could be continuous or in a registration mode.

Following the slow down nip is a corrugator 370 that stiffens the bag in a known manner.

Numerous modifications may be made to the present invention which still fall within the intended scope hereof. Thus, it should be apparent that there has been provided in accordance with the present invention a method and apparatus for folding, separating and slowing down bags that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A method of folding a plastic bag, including making a single fold at a first folding station comprising:

moving a leading edge of the bag in an input direction toward a first folding point, wherein the leading edge is traveling in the input direction as it reaches the first folding point;

first, directing the leading edge of the bag in a storage direction away from the first folding point; and second, moving the leading edge of the bag in an output direction away from the first folding point;

wherein the input direction and the output direction are, in a common plane, and further are different from the storage direction.

2. The method of claim 1 wherein the output direction is substantially the same as the input direction.

3. The method of claim 1 wherein the input direction is substantially horizontal.

4. The method of claim 3 wherein the storage direction is about 8° from vertical.

5. The method of claim 1 further including blowing air to direct the bag into the storage direction.

6. The method of claim 5 further including a blowing air to direct the bag in the output direction.

7. The method of claim 6 further including the step of using a roll imparting motion to the bag generally in the storage direction, with a turning roll.

8. The method of claim 1 further including making at least a second fold in the same manner as the first fold.

9. The method of claim 8 wherein the bag path between the first and second folds is substantially linear.

* * * * *